US005919594A

United States Patent [19]

Perry et al.

[11] Patent Number: 5,919,594

[45] Date of Patent: Jul. 6, 1999

[54] SUBSTRATE HONING METHOD

[75] Inventors: Philip G. Perry, Webster; Warren F. Brydges, Walworth, both of N.Y.

[73] Assignee: Xerox Corporation, Stamford, Conn.

[21] Appl. No.: 09/084,773

[22] Filed: May 26, 1998

[51] Int. Cl.[6] ..... G03G 5/04

[52] U.S. Cl. ..... 430/127; 430/69

[58] Field of Search ..... 430/69, 127

[56] References Cited

U.S. PATENT DOCUMENTS

| | | | |
|---|---|---|---|
| 5,238,467 | 8/1993 | Hashiba et al. | 51/293 |
| 5,332,643 | 7/1994 | Harada et al. | 430/127 |
| 5,365,702 | 11/1994 | Shank, Jr. | 451/38 |
| 5,573,445 | 11/1996 | Rasmussen et al. | 451/39 |
| 5,586,927 | 12/1996 | Herbert | 451/88 |
| 5,635,324 | 6/1997 | Rasmussen et al. | 430/127 |
| 5,821,026 | 10/1998 | Byers et al. | 430/127 |
| 5,834,148 | 11/1998 | Murayama et al. | 430/127 |

*Primary Examiner*—John Goodrow
*Attorney, Agent, or Firm*—Zosan S. Soong

[57] ABSTRACT

A photoreceptor fabrication method composed of spraying a honing composition including particulate material against a substrate in a particulate material spray distribution containing only one peak in a graph of the number of particulate material versus distance along the spray area to create a predetermined surface roughness.

9 Claims, 5 Drawing Sheets

FIG. 1
PRIOR ART
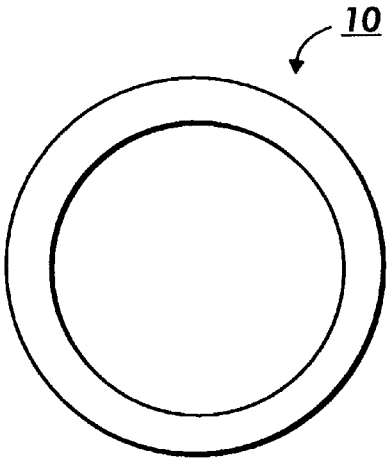
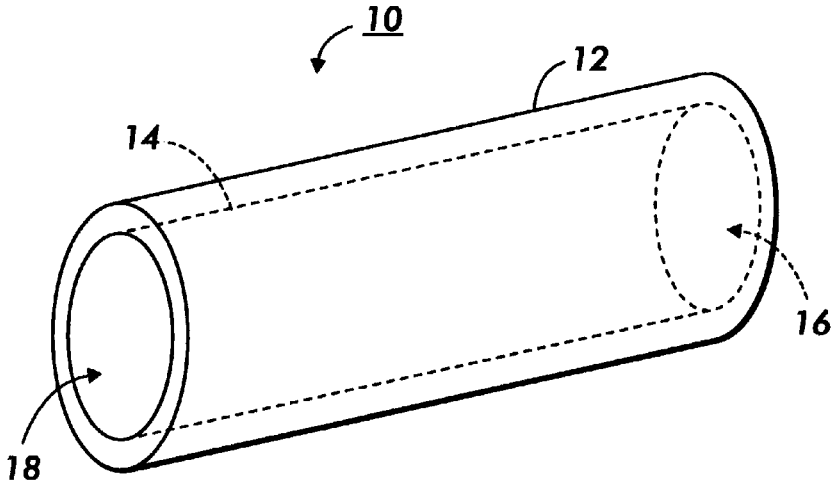
FIG. 2
PRIOR ART

SUBSTRATE HONING METHOD

FIELD OF THE INVENTION

This invention relates to a method for fabricating a photoreceptor including spraying the substrate with a honing composition to roughen the substrate surface.

BACKGROUND OF THE INVENTION

Coherent illumination is being increasingly used in electrophotographic printing for image formation on photoreceptors. Unfortunately, the use of coherent illumination sources in conjunction with multilayered photoreceptors results in a print quality defect known as the "plywood effect" or the "interference fringe effect." This defect consists of a series of dark and light interference patterns that occur when the coherent light is reflected from the interfaces that pervade multilayered photoreceptors. In organic photoreceptors, primarily the reflection from the air/charge transport layer interface (i.e., top surface) and the reflection from the undercoat layer or charge blocking layer/substrate interface (i.e., substrate surface) account for the interference fringe effect. The effect can be eliminated if the strong charge transport layer surface reflection or the strong substrate surface reflection is eliminated or suppressed.

Methods have been proposed to suppress the air/charge transport layer interface specular reflection, including roughening of the charge transport layer surface by introducing micrometer size $SiO_2$ dispersion and other particles into the charge transport layer, applying an appropriate overcoating layer and the like.

Methods have also been proposed to suppress the intensity of substrate surface specular reflection, e.g., coating specific materials such as anti-reflection materials and light scattering materials on the substrate surface and roughening methods such as dry blasting and liquid honing of the substrate surface. For example, photoreceptor substrate surfaces have been roughened by propelling ceramic and glass particles against a surface.

FIGS. 1 and 2 depict a prior art hollow cone spray nozzle 10 used in a conventional honing method to roughen the surface of photoreceptor substrates. The hollow cone spray nozzle 10 is composed of a housing 12 defining a channel 14, a round entry opening 16 where the honing composition enters the nozzle, and a round exit opening 18 where the honing composition exits the nozzle. FIG. 3 shows a graph depicting a representative particulate material spray distribution of the hollow cone spray nozzle of FIGS. 1 and 2. The phrase "distance along spray area" as used herein refers to an imaginary line along the largest dimension (e.g., length or width) of a surface impinged by the particulate material. For a cylindrical substrate, the phrase "distance along spray area" refers to an imaginary line along the longitudinal axis or length of the substrate. The graph in FIG. 3 is a rough approximation based on general principles, equipment literature and process observations. FIG. 3 indicates that a hollow cone spray nozzle produces a particulate material spray distribution having two peaks. When viewed from another perspective (see illustration of a hollow cone spray on page 1 of BEX catalog 45), the hollow cone spray nozzle produces a ring shaped particulate material spray distribution with a heavier particulate material impingement area encircling a region having lesser particulate material impingement.

Conventionally, four spray guns, each including a hollow cone spray nozzle of the type depicted in FIGS. 1 and 2, are used to propel a honing composition containing the particulate material toward a single substrate. It was discovered that when fewer than four spray guns are used, the substrate surface roughening time became longer and comparable roughness uniformity was not achieved. The resulting non-uniform surface roughness is manifested as a visible "barber pole" or "cauliflower" shaped defects on the substrate surface. Thus, there is a need, which the present invention addresses, for new methods to allow fewer spray guns to be used to roughen a substrate without lengthening the photoreceptor fabrication time or adversely affecting the substrate surface.

The following patents illustrate the honing process: Rasmussen et al., U.S. Pat. No. 5,573,445; Harada et al., U.S. Pat. No. 5,332,643; Hashiba et al., U.S. Pat. No. 5,238,467; and Herbert, U.S. Pat. No. 5,586,927, the disclosures of which are totally incorporated by reference.

A fan nozzle is disclosed in Shank, Jr., U.S. Pat. No. 5,365,702.

BEX Inc. catalog 45, page 1, depicts a flat spray, a full cone spray, and a hollow cone spray, the disclosure of which is totally incorporated herein by reference.

SUMMARY OF THE INVENTION

The present invention is accomplished in embodiments by providing a photoreceptor fabrication method comprising spraying a honing composition including particulate material against a substrate in a particulate material spray distribution containing only one peak in a graph of the number of particulate material versus distance along the spray area to create a predetermined surface roughness.

BRIEF DESCRIPTION OF THE DRAWINGS

Other aspects of the present invention will become apparent as the following description proceeds and upon reference to the Figures which represent preferred embodiments:

FIG. 1 represents an end view of a hollow cone spray nozzle;

FIG. 2 represents a perspective view of the nozzle of FIG. 1;

Unless otherwise noted, the same reference numeral in different Figures refers to the same or similar feature.

DETAILED DESCRIPTION

Figure 3:
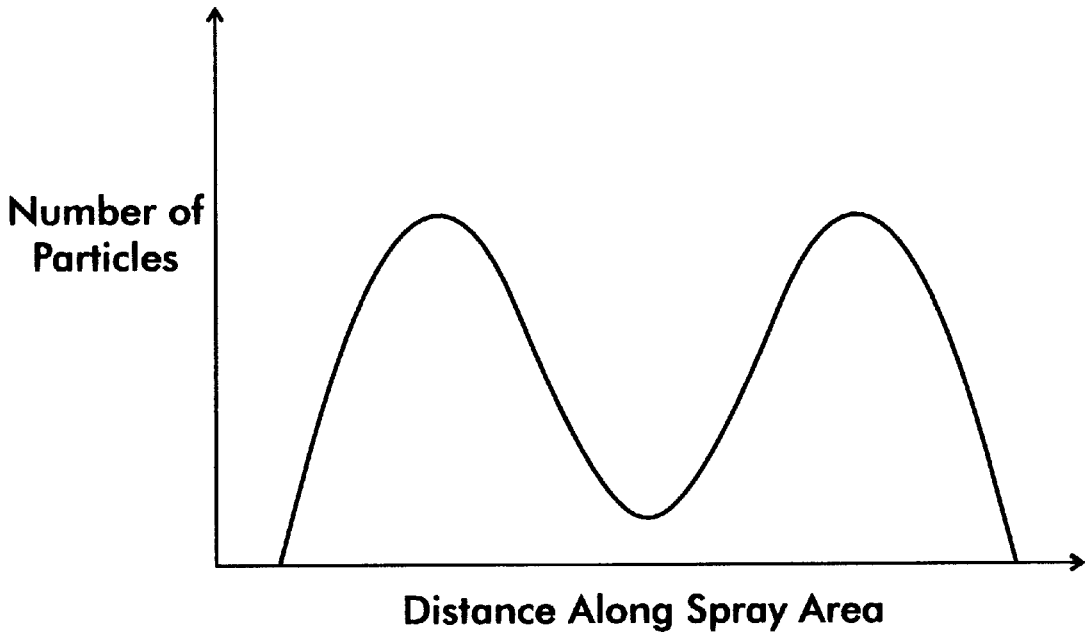
FIG. 3 PRIOR ART
FIG. 3 is a graph depicting a representative particulate material spray distribution provided by the nozzle of FIG. 1.
Figure 5:
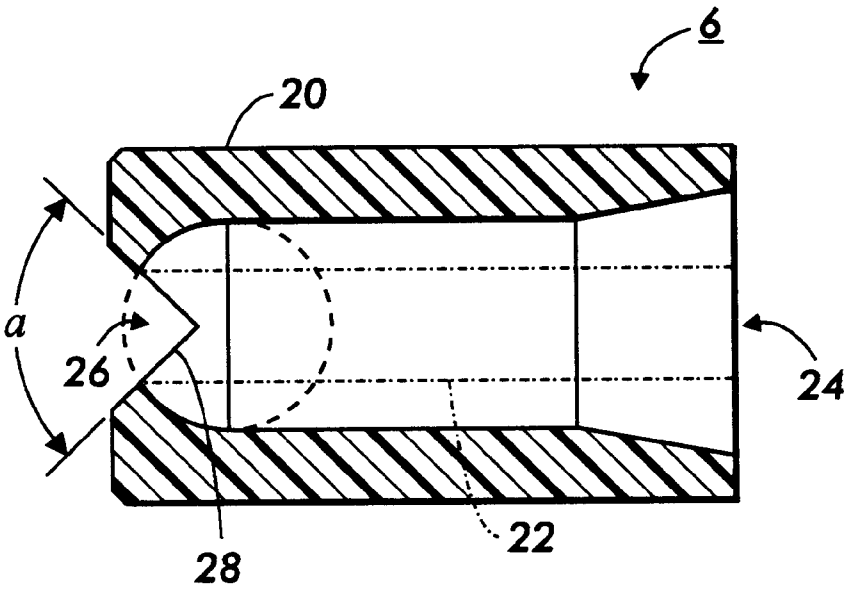
FIG. 5 represents a cross-sectional side view of the nozzle of FIG. 4.
Figure 4:
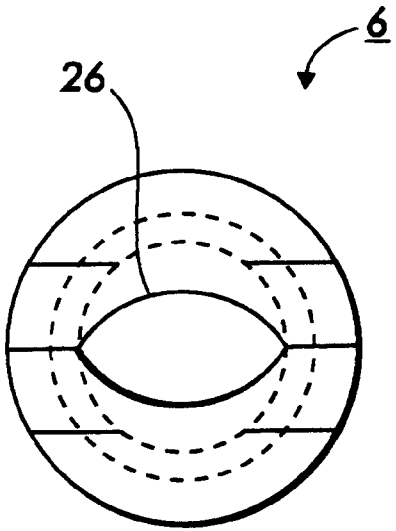
FIG. 4 represents an end view of a nozzle providing an oval shaped particulate material spray distribution.

FIGS. 4 and 5 depict a nozzle 6 composed of a housing 20 defining a channel 22, a round entry opening 24 where the honing composition enters the nozzle, and an oval shaped exit opening 26 where the honing composition exits the nozzle. A notch 28 defining an angle a ranging from about 70 about 100 degrees, preferably about 90 degrees, may be present at the exit opening 26. The nozzle may be made of a metal such as stainless steel or a plastic such as a nylon like DELRIN™, an ultrahigh molecular weight polyethylene, a high density polyethylene, RULON™ A and a DELRIN™/TEFLON™ copolymer.

Figure 6:
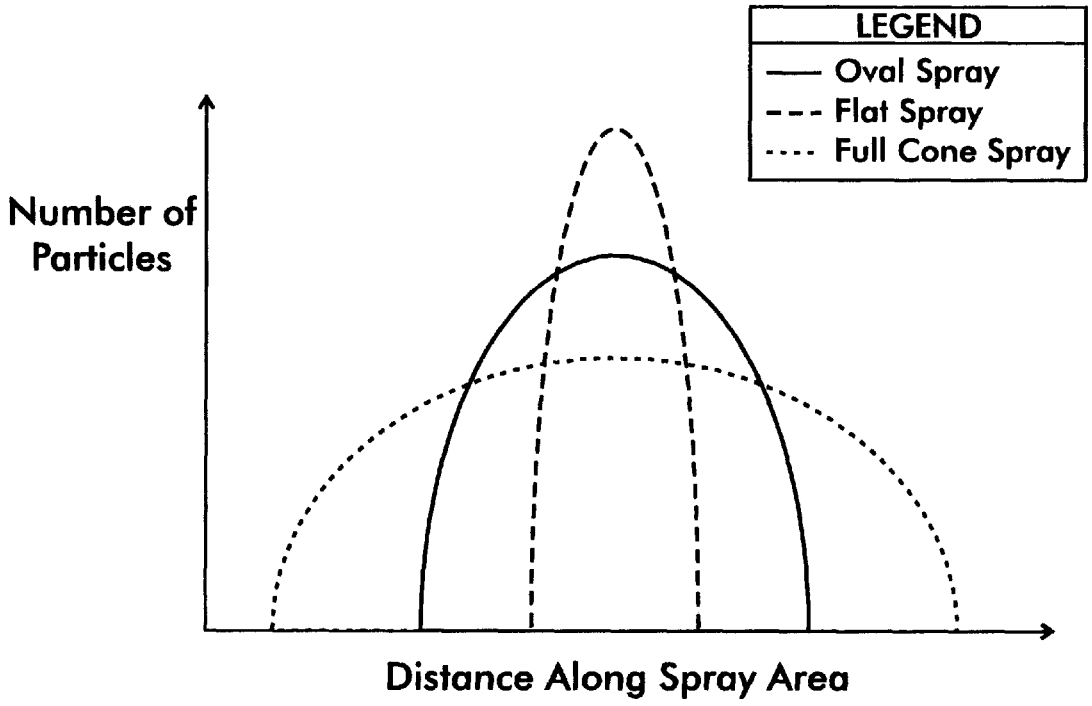
FIG. 6 is a graph depicting representative particulate material spray distributions used in the present invention.
Figure 7:
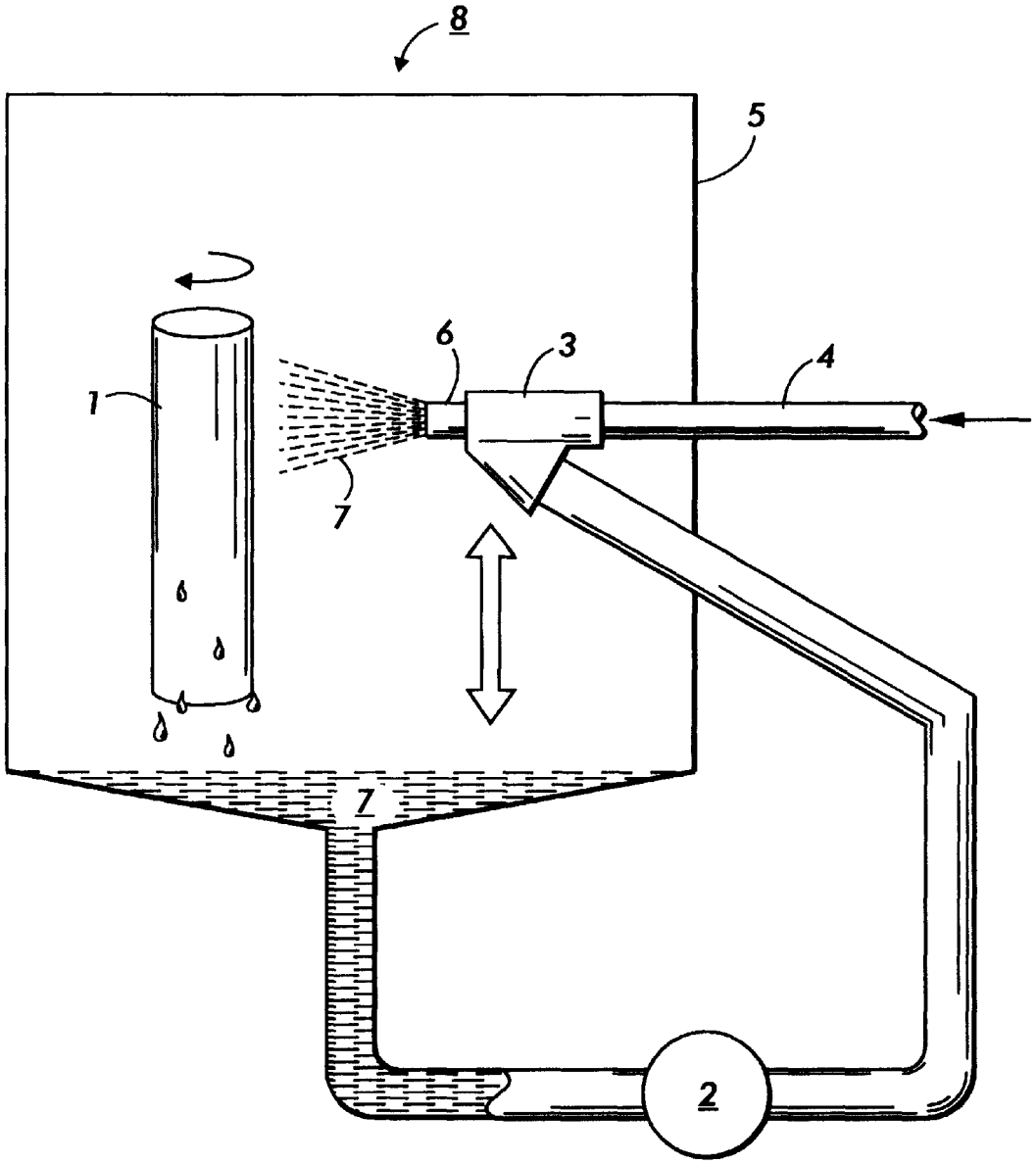
FIG. 7 represents a simplifed elevational view of a honing system that can be used in the present invention.

The nozzle of FIGS. 4 and 5 provides an oval shaped particulate material spray distribution (also referred herein as oval spray) having only one peak as seen in FIG. 6. Other nozzles may be used to create a particulate material spray distribution having only one peak such as a flat spray nozzle, which produces a flat spray, and a full cone spray nozzle, which produces a full cone spray, both nozzles being available from BEX Inc. FIG. 6 illustrates representative particulate material spray distributions produced by a flat spray and by a full cone spray. As seen in FIG. 6, the regions representing the desired particulate material spray distributions can be of varying shapes, but each region has only a single peak, whether the peak is more pointed as in the flat spray region or flatter as in the full cone spray region. As indicated by FIG. 6, the full cone spray has a wider spray area than the flat spray, with the oval spray intermediate in spray area size between the full cone spray and the flat spray. The spray patterns depicted in FIG. 6 are rough approximations based on general principles, equipment literature and process observations.

In the present invention, the particulate material (which in embodiments may be considered an abrasive agent) has a Knoop hardness ranging for example from about 1500 to about 2900 kg/mm$^2$, preferably from about 1700 to about 2600 kg/mm$^2$ and more preferably from about 1900 to about 2300 kg/mm$^2$.

The particulate material may have a 50% particle size of about 5 to about 55 micrometers in terms of cumulative percentage (measured according to JIS R6002). The particle size is preferably about 10 to about 45 micrometers and more preferably about 20 to about 40 micrometers.

Further, the particulate material may have a bulk specific gravity ranging for example from about 2 to about 5 g/ml (measured according to JIS R61260). The bulk specific gravity of the particulate material is preferably about 3 to about 4 g/ml and more preferably about 3.9 to about 4.1 g/ml.

Among suitable particulate materials, alumina containing materials are preferred. Preferable alumina containing materials are those predominantly constituted of $Al_2O_3$ and optionally containing other metal oxides in an amount of not more than about 30% by weight (particularly not more than about 22% by weight) in total. In embodiments, alumina particles are typically 99.9% pure spheres having a size ranging from about 10 to about 40 micrometers.

As the particulate material, small balls or powdery fragments of cast steel, cast iron, or glass beads may be used in embodiments of the present invention.

The honing composition may be dry (i.e., absent any fluid, where only the particulate material is present) or may include a liquid. When a liquid is present, the particulate material may be substantially insoluble in the liquid, where the amount of the undissolved particulate material ranges from about 90% to 100% by weight based on the total weight of the particulate material in the honing composition. In other embodiments, the honing composition may be a slurry, where the particulate material is soluble in the liquid but the honing composition is a saturated solution of the particulate material so as to minimize dissolution of the particulate material in the liquid. Having a saturated solution ensures sufficient abrasiveness of the honing composition. The particulate material may be present in the honing composition in an amount ranging for example from about 10 to about 30% by weight, preferably from about 15 to about 25% by weight, and most preferably about 20% by weight, based on the total weight of the honing composition.

A buffer, a dispersant, and/or a surfactant may be optionally present in the honing composition at a concentration for example of less than about 1% by weight based on the weight of the honing composition.

The liquid in the honing composition may be any suitable fluid such as water, preferably deionized water, or organic fluids such as alcohols, polyhydric alcohols, alkyl halides, and methylene chloride. Mixtures of two, three, or more liquids can be employed in the honing composition.

Any suitable substrate may be treated by the present invention including metal substrates typically employed as photoreceptor substrates such as those fabricated from for example stainless steel, nickel, aluminum, and alloys thereof. Aluminum or aluminum alloy substrates are preferred. Typical aluminum alloys include, for example, 1050, 1100, 3003, 6061, 6063, and the like. Alloy 3003 contains Al, 0.12 percent by weight Si, 0.43 percent by weight Fe, 0.14 percent by weight Cu, 1.04 percent by weight Mn, 0.01 percent by weight Mg, 0.01 percent by weight Zn, 0.01 percent by weight Ti, and a trace amount of Cr. The size and distribution of inclusions and intermetallic compounds in the alloy should be below the level at which the inclusions and intermetallic particles would pose a problem for the honing process. Nonuniform surface texture with patches of unhoned regions may result if many large inclusions or intermetallics are present. Similarly, the ductility properties of the aluminum substrate should be substantially uniform to ensure a uniform texture upon completion of the honing process. Generally, the surface of the substrate may be relatively smooth prior to honing. Typical smooth surfaces are formed by, e.g., diamond lathing, specialized extrusion and drawing processes, grinding, buffing and the like. After smoothing but prior to any honing, the substrate surface roughness may be in the range for example of $R_a$ of about 0.05 micrometers and $R_{max}$ of about 0.5 micrometers to $R_a$ of about 0.2 micrometers and $R_{max}$ of about 2.0 micrometers.

$R_a$ is the arithmetic average of all departures of the roughness profile from the center line within the evaluation length. $R_a$ is defined by a formula:

$$R_a = \frac{1}{l_m}\int_0^{l_m} |y| dx$$

in which $l_m$ represents the evaluation length, and $|y|$ represents the absolute value of departures of the roughness profile from the center line.

The expression $R_{max}$ represents the largest single roughness gap within the evaluation length. The evaluation length is that part of the traversing length that is evaluated. An evaluation length containing five consecutive sampling lengths is taken as a standard.

Typically, the substrate is cylindrical or drum-shaped, and is cleaned by any suitable technique prior to honing to remove any foreign substances introduced to the surface during any of the aforementioned smoothing processes. Although a cylindrical substrate is preferred, as long as honing process parameters are met, any substrate geometry such as a hollow or solid cylinder, a flat sheet, a seamed or unseamed belt, or any other form that allows the utilization of conventional coating techniques such as dip coating, vapor deposition and the like can be used.

The surface morphology produced by the present method may be defined by the following parameters: $R_a$ (mean roughness), $R_t$ (maximum roughness depth), $R_{pm}$ (mean levelling depth), $W_t$ (waviness depth), and $P_t$ (profile depth), wherein preferred values for minimizing or eliminating the interference fringe effect are described below. $R_a$ is defined above and preferably ranges from about 0.05 to about 0.7 micrometer, more preferably from about 0.1 to about 0.6 micrometer, and most preferably from about 0.17 to about 0.23 micrometer. $R_t$ is the vertical distance between the highest peak and the lowest valley of the roughness profile R within the evaluation length and preferably ranges from about 0.5 to about 4 micrometers, and more preferably less than about 3.0 micrometers. $R_{pm}$ is the mean of five levelling depths of five successive sample lengths and preferably ranges from about 0.2 to about 2 micrometers, and more preferably from about 0.55 to about 0.75 micrometers. $W_t$ is the vertical distance between the highest and lowest points of the waviness profile W within the evaluation length and preferably ranges from about 0.1 to about 1 micrometer, and more preferably from about 0.15 to about 0.5 micrometer. $P_t$ is the distance between two parallel lines enveloping the profile within the evaluation length at their minimum separation and preferably ranges from about 0.8 to about 6 micrometers, and more preferably from about 1 to about 4 micrometers. Significant suppression of the interference fringe effect may be observed in embodiments of the present invention at the light source wavelengths conventionally used, including a light source having a wavelength at 780 nm.

All measurements of the various surface roughness parameters described herein may be made with a profilameter such as Perthen Model S3P or Model S8P manufactured by Mahr Feinpruef Corporation. Generally, a stylus with a diamond tip is traversed over the surface of the roughened substrate at a constant speed to obtain all data points within an evaluation length. The radius of curvature of the diamond tip used to obtain all data referred to herein is 2 micrometers.

In embodiments, the present method may create the desired surface roughness with minimal removal of the substrate surface material. This can be verified by determining whether there is a change in color in the used honing composition which is collected after the honing step where a change in color indicates the presence of excessive amounts of the substrate surface material. In addition, the used honing composition can be analyzed chemically to determine the amount of suspended and/or dissolved substrate surface material.

The following description illustrates the operation of a honing system 8 using the present invention. Within the honing chamber 5 of the honing system 8 are a substrate 1 and a spray gun 3 which includes a nozzle 6 which may be detachable and an air introduction tube 4. A pump 2 feeds the honing composition 7 to the spray gun 3 which sprays the honing composition at the surface of a cylindrical substrate 1. The distance between the spray gun and the substrate to be treated is between about 100 mm and about 300 mm. The cylindrical substrate is rotated about its axis at a surface speed of between about 40 cm/sec (where the substrate is for example an 84 mm diameter drum) and about 60 cm/sec (where the substrate is for example a 30 mm diameter drum), or about 100 to about 400 rpm. Particulate material is present in the wet honing composition in an amount ranging from about 15% to about 25% by weight solids, with the remainder being RO (reverse osmosis) water or softened (calcium and magnesium ions removed) water. The pressure applied through the air introduction tube to the honing composition as it is fed to the spray gun is about 0.5 to about 2.0 kg/cm$^2$, preferably about 1.0 to about 1.5 kg/cm$^2$. The spray gun is traversed at a speed of between about 500 to about 2000 mm/min along an axis parallel to the axis of the cylindrical substrate. An acceptable surface roughness as described herein on the surface of the substrate can be achieved in a single pass of the spray gun. These parameters are generally applicable to spray guns having a nozzle of a diameter between about 5 mm and about 10 mm. If desired, the ends of the cylindrical substrate may be masked to prevent roughening of the area that is to remain free of coating material. Masking may be accomplished by any suitable technique that provides a shield between the substrate and the honing media.

In embodiments, the surface of the substrate after completion of the honing process may exhibit an irregular pattern (e.g., indents, scalloped or craters of less than 4 micrometers crater depth and/or no flats) having a controlled surface roughness, free of embedded particles or large craters produced by prior art honing methods. This surface structure also may be free of sharp crevices where protruding edges can adversely affect the uniformity of the undercoating layer and charge generating layer. Also, the protrusions can result in catastrophic electrical discharge that can destroy the photoconductor with black spot printout.

The present invention offers a number of benefits. For example, because the particulate material is concentrated along the longitudinal axis of the substrate (see FIG. 6) faster traverse speeds (shorter process times) and/or fewer spray guns (less equipment) can be used, thereby resulting in a cost reduction. Additionally, because the single peak spray pattern of the present invention maximizes the particulate material concentration along the longitudinal axis of a cylindrical substrate at any given instant (at the midway point along the substrate length, the spray pattern of the present invention may cover the entire drum unlike the spray pattern produced by the hollow cone spray nozzle), the resulting surface is measurably and visibly more uniform, thereby yielding improved product quality and manufacturing yields (eliminates or minimizes product reject due to "barberpole" and "cauliflower" defects).

In fabricating a photosensitive imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer. Typical application techniques include spraying, dip coating, roll coating, wire wound rod coating, and the like. Dip coating is a preferred coating technique where the dipping and raising motions of the substrate relative to the coating solution may be accomplished at any effective speeds. The dipping speed may range for example from about 200 to about 1500 mm/min and may be a constant value. The take-up speed during the raising of the substrate from the coating solution may range for example from about 50 to about 500 mm/min and may be a constant value. Drying of the deposited coating may be effected by any suitable conventional technique such as oven drying, infrared radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The photosensitive imaging member produced according to the invention can be tested for print quality assessment in a Xerox Document Centre 230 (a multifunction laser printing machine) at an initial charging voltage of about 480 volts. The Document Center 230 has a 780 nm wavelength laser diode as the exposure source and a single component discharged area development (DAD) system with 7 micrometer toner. Interference fringe effect is tested in a gray scale print mode using specified halftone patterns. The interference fringes, or plywood fringes, are not observed, and no degradation of print quality is observed due to black spots. Similar results may be achieved with other laser-based machines, e.g., those with an exposure light source that operates in the range of 600–800 nm.

Here are preferred parameters for the present method:

Particulate material: aluminum oxide (27 micrometers) and glass shot (40 micrometers). Other potential particulate materials include shot and grit of: emery, garnet, zirconia, flint, steel, sand, silicon carbide, polycarbonate, sodium bicarbonate, borax, corn cobs, walnut shells.

Honing composition liquid: water is the preferred carrier with the water quality ranging from deionized (referred herein as DI), to "soft," to reverse osmosis (referred herein as RO), to tap.

Percent solids in honing composition: a concentration of about 26% (wt) +/−6%. One may also employ about 15–20% (wt) alumina with an oval spray nozzle.

Dimension of the oval shaped exit opening for the nozzle: 7 mm wide and 11 mm long at the extremes.

Spray gun to substrate distance: This distance is directly related to air pressure and generally speaking is from about 250 to about 300 mm. Preferred specific distances are 295 mm and 265 mm.

Air pressure: about 15 to about 32 psi, with preferred narrower ranges being about 17–20 psi and about 26–32 psi.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

A 6063 alloy lathed aluminum cylindrical hollow substrate, 84 mm diameter and 340 mm long, with a surface roughness of $R_a$ being 0.05 micrometer was prepared for photoconductive coatings using the following honing/cleaning process:

1. Spray rinse with high quality water (RO or DI) to remove soluble oils and surface debris.

2. Hone the substrate using the following parameters:

a) Particulate material concentration in the honing composition: 20% (wt);

b) Particulate material: alpha alumina, 27 micrometer;

c) Honing composition liquid: RO water>100 Kiloohm-cm resistivity;

d) Nozzle: oval spray nozzle (7 mm wide and 11 mm long at the extremes for the oval shaped exit opening);

e) Honing composition temperature: ambient;

f) Honing composition flow rate: 60 liter per minute;

g) Air pressure: 20 psi;

h) Spray gun traverse speed: 400 mm per minute;

i) Substrate rotation speed: 400 rpm;

j) Spray gun-to-substrate distance: 265 mm;

k) Number of spray guns per substrate: one; and l) Cycle time: one minute.

3. Spray rinse with high quality water (RO or DI) to remove residual honing composition, cycle time one minute.

4. Immersion rinse with high quality water (RO or DI) and ultrasonic agitation to remove residual honing composition, cycle time one minute.

5. Immersion clean using a neutral detergent at 40 deg C. with ultrasonic agitation, cycle time one minute.

6. Spray rinse with DI water to remove residual detergent, cycle time one minute.

7. Immersion rinse with DI water to insure detergent removal.

8. Immersion rinse with high quality DI water at 60 deg C., withdrawing substrate at 300 mm per minute to facilitate drying, cycle time one minute.

9. Dry substrate at 350 deg C. using HEPA (high efficiency purified air) filtered recirculated air, cycle time one minute.

10. Substrate was then ready for coating with the photoconductor layers.

The first layer, an undercoat layer (UCL) used as an electrical blocking and adhesive layer, was applied, as all coatings were, by dip coating technology. A "three-component" UCL consisting of: polyvinylbutyral (6%), zirconium acetyl acetonate (83%) and gamma-aminopropyl triethoxy silane (11%) (all wt. %) mixed, in the order listed, with n-butyl alcohol in a 60:40 solvent to solute weight ratio was used for the UCL. The UCL was applied in a thickness of approximately one micrometer to the cleaned honed substrate by dip coating.

The substrate was next coated with an about 0.2 micrometer thick charge generating layer (CGL) of HydroxyGallium Phthalocyanine (OHGaPc) and a terpolymer (VMCH) of: vinyl chloride (83%), vinyl acetate (16%) and maleic anhydride (1%), dissolved in n-butyl acetate (4.5% solids) in a 60:40 ratio (60 OHGaPc:40 VMCH). Atop the CGL was coated a 24 micrometer thick charge transport layer (CTL) of polycarbonate, derived from bis phenyl Z (PCZ400) and N,N'-diphenyl-N,N'-bis(3-methylphenyl)-(1,1'-biphenyl)-4,4'diamine dissolved in tetrahydrofuran.

After coating and drying, the resulting photoreceptor was copy quality tested in a Xerox Document Centre 230. The prints were of satisfactory quality and were free of the "plywood effect."

COMPARATIVE EXAMPLE 1

A photoreceptor was fabricated and tested using the same procedures as described in Example 1 except that the lathed substrate was not subjected to the honing treatment. The prints consistently showed the "plywood effect."

COMPARATIVE EXAMPLE 2

A photoreceptor was fabricated using the same procedures as described in Example 1 except that a hollow cone spray nozzle (diameter about 11 mm) replaced the oval spray nozzle and that the air pressure was about 12 to about 15 psi. When evaluated for surface quality, the resulting photoreceptor showed rejectable levels of "barber pole" and "cauliflower" defects which are due to variations in substrate honing uniformity.

Other modifications of the present invention may occur to those skilled in the art based upon a reading of the present disclosure and these modifications are intended to be included within the scope of the present invention.

We claim:

1. A photoreceptor fabrication method comprising spraying a honing composition including particulate material against a substrate in a particulate material spray distribution containing only one peak in a graph of the number of particulate material versus distance along the spray area to create a predetermined surface roughness.

2. The method of claim 1, wherein the spraying is accomplished with a flat spray.

3. The method of claim 1, wherein the spraying is accomplished with a full cone spray.

4. The method of claim 1, wherein the spraying is accomplished with an oval spray.

5. The method of claim 1, wherein the predetermined surface roughness is defined by $R_a$ ranging from about 0.05 to about 0.7 micrometer, $R_t$ ranging from about 0.5 to about 4 micrometers, $R_{pm}$ ranging from about 0.2 to about 2 micrometers, $W_t$ ranging from about 0.1 to about 1 micrometer, $P_t$ ranging from about 0.8 to about 6 micrometers.

6. The method of claim 1, wherein the particulate material includes alumina containing particles.

7. The method of claim 1, further comprising rotating the substrate during the spraying.

8. The method of claim 1, wherein the honing composition includes water.

9. The method of claim 1, further comprising depositing onto the substrate subsequent to the spraying a material selected from the group consisting of a charge generating material and a charge transport material.

* * * * *